United States Patent [19]

McCormick et al.

[11] Patent Number: 4,625,799

[45] Date of Patent: Dec. 2, 1986

[54] CLEANING TOOL

[75] Inventors: William H. McCormick, Plano; Charles C. Cobb, Lewisville, both of Tex.

[73] Assignee: Otis Engineering Corporation, Carrollton, Tex.

[21] Appl. No.: 746,313

[22] Filed: Jun. 19, 1985

[51] Int. Cl.[4] ..... E21B 37/00

[52] U.S. Cl. ..... 166/223; 166/73; 166/312; 166/240; 134/167 C

[58] Field of Search ..... 166/73, 72, 222, 223, 166/171, 177, 311, 312, 240; 299/16, 17; 175/424; 134/167 C, 168 C, 22.12

[56] References Cited

U.S. PATENT DOCUMENTS

| | | | |
|---|---|---|---|
| Re. 31,495 | 1/1984 | Zublin | 166/223 X |
| 3,154,147 | 10/1964 | Lanmon, II | 166/240 X |
| 3,703,104 | 11/1972 | Tamplen | 166/240 X |
| 3,720,264 | 3/1973 | Hutchison | 166/311 |
| 3,791,447 | 2/1974 | Smith et al. | 166/311 |
| 4,088,191 | 5/1978 | Hutchison | 166/223 |
| 4,355,685 | 10/1982 | Beck | 166/240 |
| 4,442,899 | 4/1984 | Zublin | 166/222 X |
| 4,518,041 | 5/1985 | Zublin | 166/222 X |

OTHER PUBLICATIONS

Effect of a Drag Reducing Agent on Oil Well Technology by J. W. Hoyt, Apr. 2, 1984.

Hyperclean Operating Assembly by Downhole Services, Inc., Apr. 1981.

Superwater by Berkeley Chemical Research, Apr. 1978.

Cutting by Water Jet by Flow Systems, Inc., Feb. 1980.

Diffusion of Submerged Jets by M. L. Albertson, Y. B. Dai, R. A. Jensen and H. Rouse, A.S.C.E., vol. 74, pp. 1571–1596, 1948.

Momentum and Mass Transfer in a Submerged Water Jet by W. Forstall, E. W. Gaylord, Journal of Applied Mechanics, Jun. 1955.

Abrasive Water Jets by R. B. Aronson, Machine Design, Mar. 21, 1985.

*Primary Examiner*—Stephen J. Novosad

*Attorney, Agent, or Firm*—Keaty & Keaty

[57] ABSTRACT

An apparatus for pressurized cleaning of flow conductors. The apparatus utilizes a control slot formed in a zig-zag pattern and a pin which travels in the slot. The slot and pin assist in indexingly rotating the nozzle section of the apparatus when the apparatus is reciprocated in alternate directions in the flow conductor. Pressurized cleaning fluid is supplied to the apparatus and is directed radially outward through nozzles against the flow conductor in such a manner as to progressively clean the flow conductor as the nozzle section rotatively indexes. Another set of nozzles may be included, if desired, in the lower end of the apparatus to allow cleaning along the longitudinal axis.

15 Claims, 10 Drawing Figures

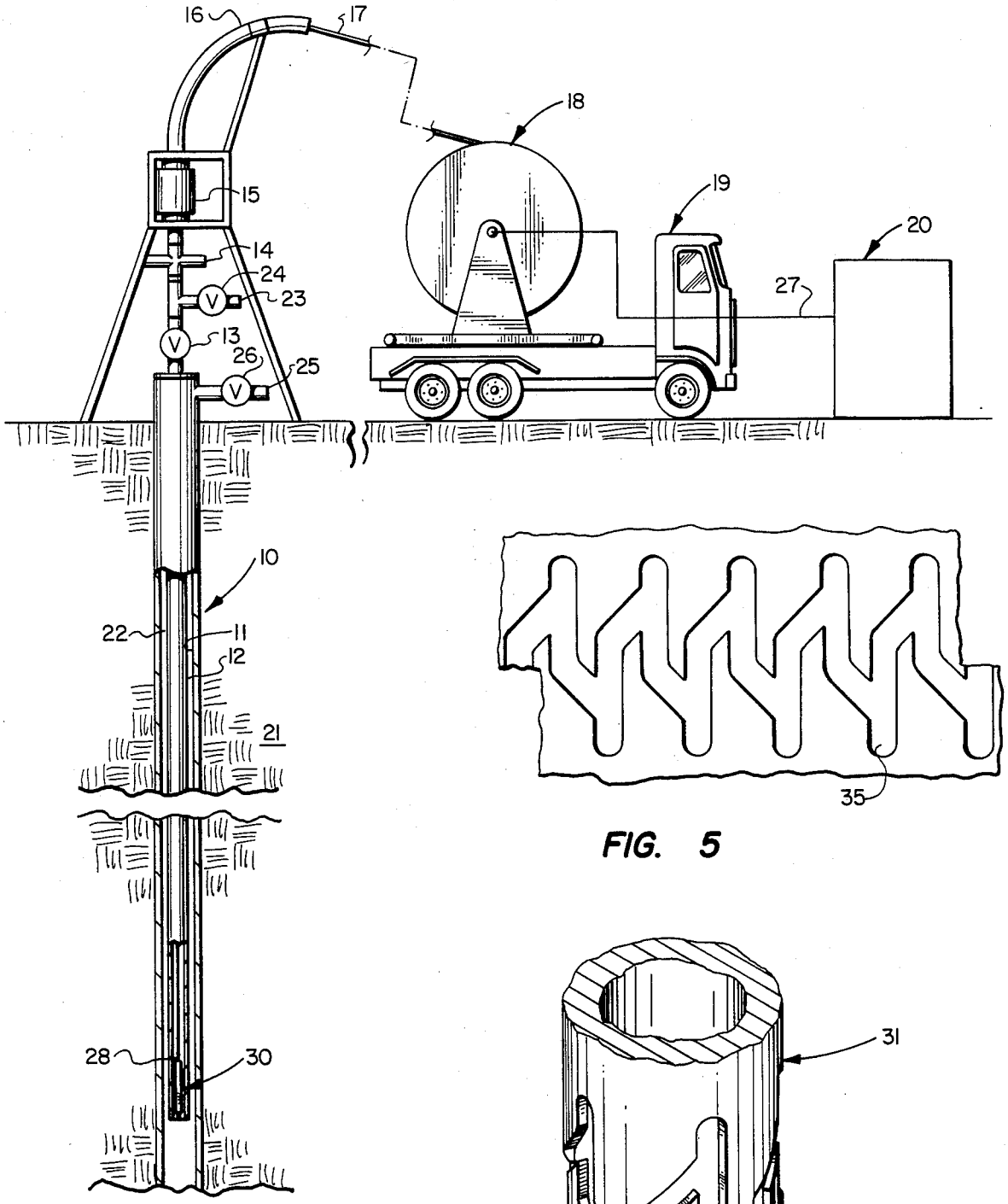
FIG. 1
FIG. 5
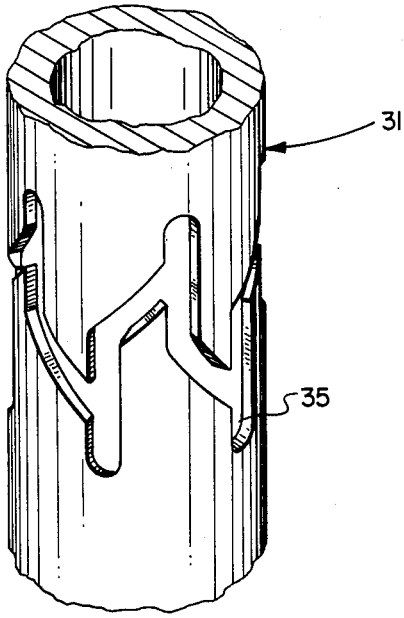
FIG. 6

CLEANING TOOL

BACKGROUND OF THE INVENTION

1. Field of the Invention

This invention relates to pressurized cleaning of flow conductors by an indexing, reciprocating and rotating apparatus utilizing high velocity fluid flow directed outward from the apparatus by means of nozzles.

2. Description of Related Art

In the past, various configurations of devices were used to attempt removal of foreign material from the interior of well tubing. This well tubing ranged from unperforated and perforated tubulars to slotted or wire-wrapped well liners. This well tubing often became plugged or coated with corrosion products, sediments and hydrocarbon deposits.

Wire brushes, scrapers, scratchers and cutters of various designs were among the first tools used to try to remove unwanted deposits. Some of these tools did not reach into the slots or perforations. Those that did had to have wires or feelers thin enough to enter the slot or perforation and were often too thin to provide much cleaning force. Then several types of washing tools were introduced to the industry utilizing pressurized jets of fluid to attempt to dislodge the undesired material from the well tubing. In the late thirties and early fifties (1955–59), the development of jet cleaning advanced from low velocity for use in cleaning and acidizing to utilization of abrasive particles suspended in the fluid for hydraulic fracturing of formations to enhance recovery of hydrocarbons. Abrasives were utilized for cleaning flow conductors, but results were less than favorable since the material of the flow conductors was eroded along with the foreign material plugging or coating the flow conductors.

In the early seventies, Stanley O. Hutchison received the following U.S. patents for High Pressure Jet Well Cleaning: U.S. Pat. Nos. 3,720,264; 3,811,499; 3,829,134; 3,850,241 and 4,088,191. These designs solved a lot of problems of prior devices by enabling the user to adjust the distance between the well tubing and the end of the jet nozzle. This distance, called the standoff distance, is considered critical to proper cleaning. Calculation of these distances is found in many technical publications. These devices, although an improvement in the art, still left many problems unsolved.

An attempt to solve several of these problems was made by Casper W. Zublin. Zublin, a licensee of the Hutchison patents, received U.S. Pat. Nos. Re. 31,495; 4,441,557; 4,442,899 and 4,518,041 (recently issued).

U.S. Pat. No. Re. 31,495 added a centralizer to help center the jet nozzles and provide a means to jar out of tight places in the tubing. This device is rotated by a power swivel at the surface.

U.S. Pat. No. 4,441,557 claims nozzles spaced so as to direct cleaning fluid onto the pipe in a certain pattern. The device is rotated at a constant speed by the power swivel at the surface.

U.S. Pat. No. 4,442,899 claims a method and system for a nonrotating device utilizing nozzles and alternating pressure to create an oscillating twisting force according to a certain formula.

U.S. Pat. No. 4,518,041 is formerly application No. 360,492. Per a copy of application No. 360,492, the inventor claims method and a system utilizing a device that is not rotated by the tubing at the surface. The device has nozzles which, like the device in U.S. Pat. No. 4,442,899, direct the flow of the cleaning fluid in such a manner as to tend to twist the tubing and the device. The amount of twist is varied by varying the pressure of the cleaning fluid supplied to the device. The system calls for some nozzles to be directionally coincidental with the horizontal axis. Other claims relate to a method of calculating the amount of twist. According to the applicant, these methods and systems are an effort to avoid the inefficiency of having a rotational rig at the surface to rotate the entire tubing. A device to do this is described but not claimed.

SUMMARY OF THE INVENTION

The present invention is an apparatus for cleaning flow conductors including but not limited to downhole tubing and flow lines. The device is attached to a flexible or rigid conduit such as coil tubing or small diameter pipe which is connected to a source of cleaning fluid. The cleaning fluid is pumped under pressure to the cleaning tool. The tubing with the cleaning tool attached is run into the flow conductors to the area to be cleaned.

The device has a nozzle body which is selectively rotated by a control slot made in a pattern such that when a pin in the nozzle body follows the control slot, the nozzle body indexes and rotates. Longitudinal movement of the device in either direction is restricted by resilient springs which cause the inner mandrel to move in a relatively opposite direction to the nozzle body. This longitudinal movement is translated into rotational movement in part by the control slot in the inner mandrel and the pin in the nozzle body. As the device is moved in alternating directions, the nozzle body indexes, by means of the control slot and pin, and rotates to clean a different portion of the flow conductor.

The present invention eliminates the complicated method of calculating angular twisting as required with previous devices thus freeing the user of the device for other tasks. The present invention eliminates the need to twist the tubing connected to the cleaning tool thereby relieving the tubing of the stress caused by the constant twisting forces. The present invention allows the pressure to be held constant at selected pressures thereby easing wear on the pump.

It is therefore one object of this invention to provide a cleaning tool which will indexingly rotate when the device is reciprocated in alternate directions thereby allowing the nozzles of the nozzle body to direct the cleaning fluid to a different segment of the flow conductor.

Another object of this invention is to provide a cleaning tool which can be operated without twisting of the tubing supplying the cleaning fluid to the cleaning tool.

A further object is to provide a tool whose nozzle body may be replaced due to wear or change in size of flow conductor without replacing the entire tool.

Another object is to provide a tool with a restriction in one end of the tool that can be used as a plug or as a nozzle head to remove corrosion, sediments and hydrocarbon in line with the longitudinal axis of the tool.

BRIEF DESCRIPTION OF THE DRAWING

FIG. 1 is a schematical view showing the tool in place in a flow conductor in a well bore. The view shows the tool connected to a source of cleaning fluid and a device capable of raising and lowering the tool within the flow conductor.

FIG. 5 is a development view showing the control slot pattern.

FIG. 6 is a fragmentary view displaying the control slot on the mandrel means.

FIG. 7B also shows an alternative restriction means which contains nozzles for spraying and an antirotation means which prevents the center section of the nozzle body from rotating relative to the other two sections of the nozzle body. The portion of the tool not shown above the control slot means in FIG. 7A is the same configuration as shown in FIG. 2A.

DESCRIPTION OF THE PREFERRED EMBODIMENTS

Figure 2A:
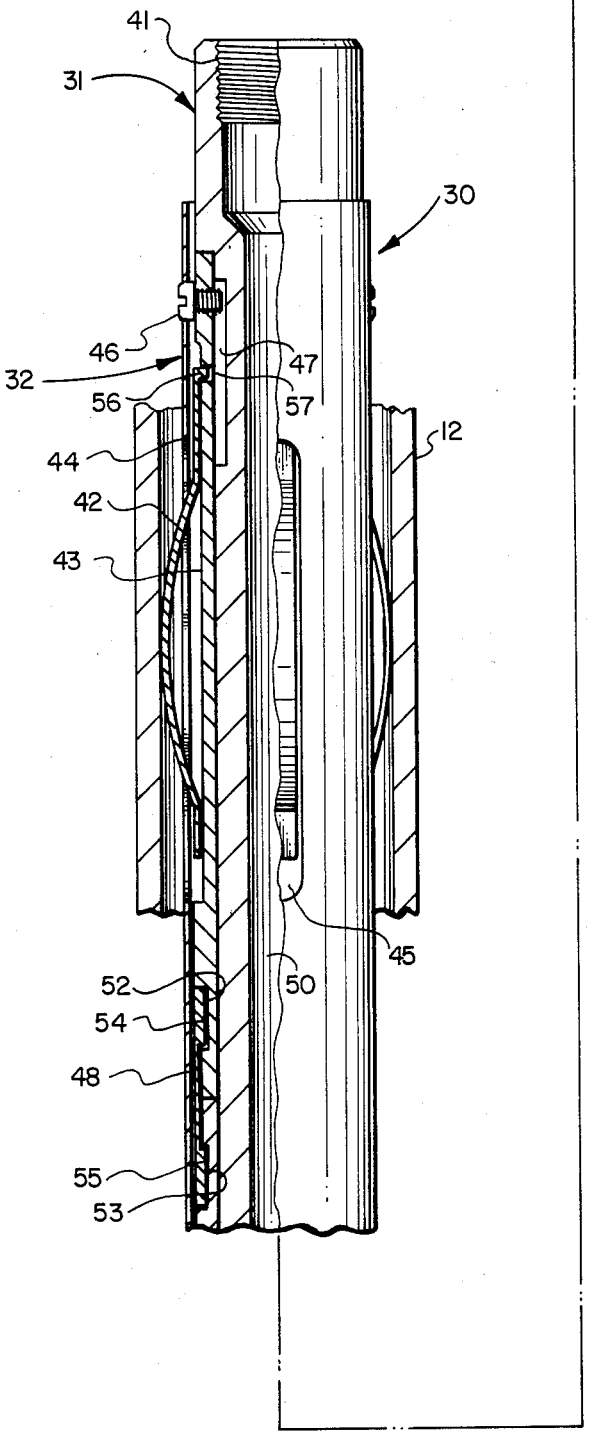
FIGS. 2A and 2B taken together constitute a longitudinal view, partly in section and partly in elevation, showing the tool constructed in accordance with the present invention. The tool is shown extended longitudinally to the lowermost position of the control slot and pin.

Referring to FIG. 1, it will be seen that a well 10 is schematically shown with the inventive apparatus now called a cleaning tool 30 lowered into flow conductor 12 by means of flexible tubing 17. Flow conductor 12 is, in this figure, well tubing or a liner, the inside of which is in need of cleaning.

Well 10 has been drilled into earth formation 21. Well casing 11 is disposed in the well and extends through the formation to a predetermined depth. A flow conductor 12 extends from the surface to another predetermined depth. A wellhead 13 closes the upper end of the casing about the well tubing thereby closing the upper end of annulus 22. A flow line 23 is connected to the flow conductor 12 above the wellhead 13. A wing valve 24 controls flow between the flow conductor 12 and the flow line 23. A casing flow line 25 and a casing wing valve 26 provide for control of flow from the annulus 22 if required.

Above the wellhead 13 is a blowout preventer 14 through which the flexible tubing 17 may be run without any leakage of pressure from the well 10 around the flexible tubing 17. The blowout preventer usually involves pressing an elastomeric seal around a small diameter tubing by means of hydraulic or mechanical pressure. Above the blowout preventer 14, a tubing injector 15 is shown. This device is used to run flexible tubing 17 into and withdraw it from the flow conductor 12. Above injector 15 is a curved tubing guide 16 which aids in guiding the curved flexible tubing 17 into injector 15 as the flexible tubing 17 winds off reel 18 upon which the flexible tubing 17 is stored. The reel 18 is shown carried by a truck 19 to which it may be permanently attached, or the reel 18 may be mounted to a skid unit which may be placed on the ground or other surface or carried by a truck. As shown in FIG. 1, the flexible tubing 17 is connected to a pressurized source of cleaning fluid 20. Such pressure may be provided by a pump or other suitable supplier of pressure. Supply line 27 allows for passage of cleaning fluid under pressure to flexible tubing 17 from the source of pressurized cleaning fluid 20. The lower end 28 of flexible tubing 17 is connected by suitable sealing means to the upper end of cleaning tool 30 usually by a threaded connector compatible with thread 41 in mandrel means 31.

Figure 2B:
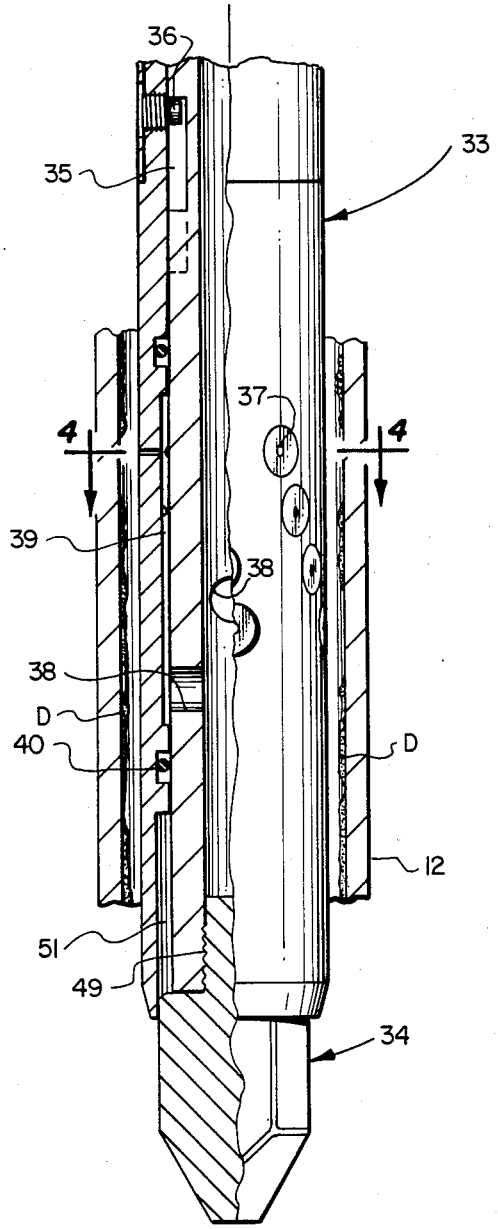

Referring to FIGS. 2A and 2B, the cleaning tool 30 is shown partly in elevation and partly in section. The nozzle means 37 shown may be arranged in different configurations, to accommodate different tubing sizes for example, other than that shown.

Figure 7A:
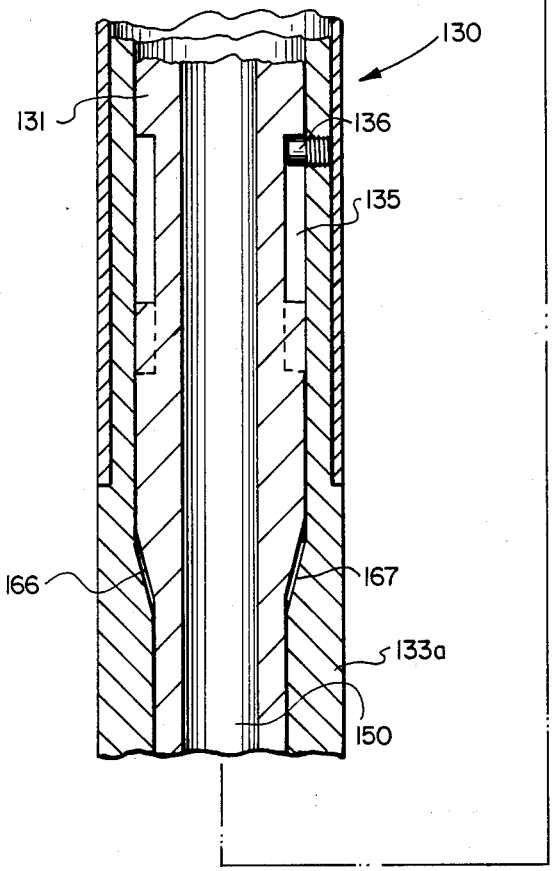
FIGS. 7A and 7B taken together constitute a longitudinal view, partly in section and partly in elevation, showing an alternative embodiment of the invention with the nozzle body in three sections to allow for replacement of only the section of the nozzle body containing the nozzles.
Figure 7B:
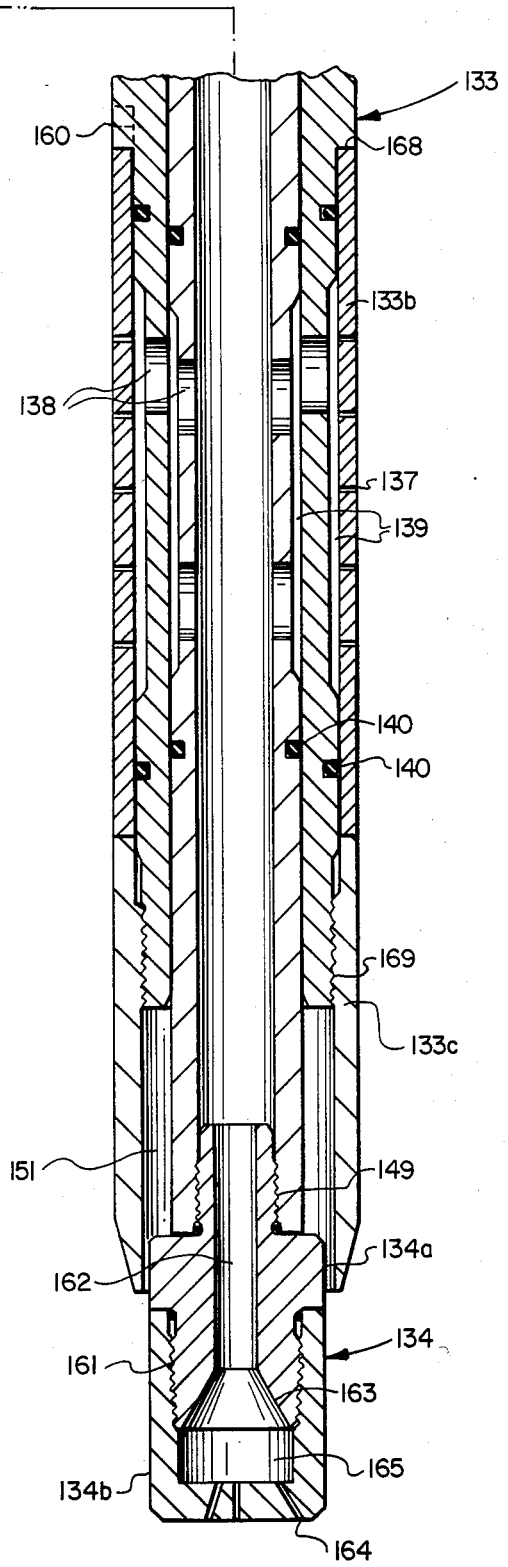

The cleaning tool 30 has mandrel means 31 which has a longitudinal passageway 50 extending therethrough. Cleaning fluid flowing through the longitudinal passageway 50 of mandrel means 31 is restricted from flowing out the other end by a restriction means 34 sealingly engaged with the mandrel means 31. An example of such a seal is shown by the restriction means 34 being threadedly engaged utilizing thread 49 in mandrel means 31. Shown in FIG. 2B is a restriction means 34 completely blocking fluid flow. However, FIG. 7B shows a restriction means 134 containing second nozzle means 164 for cleaning in a longitudinal direction.

Figure 3A:
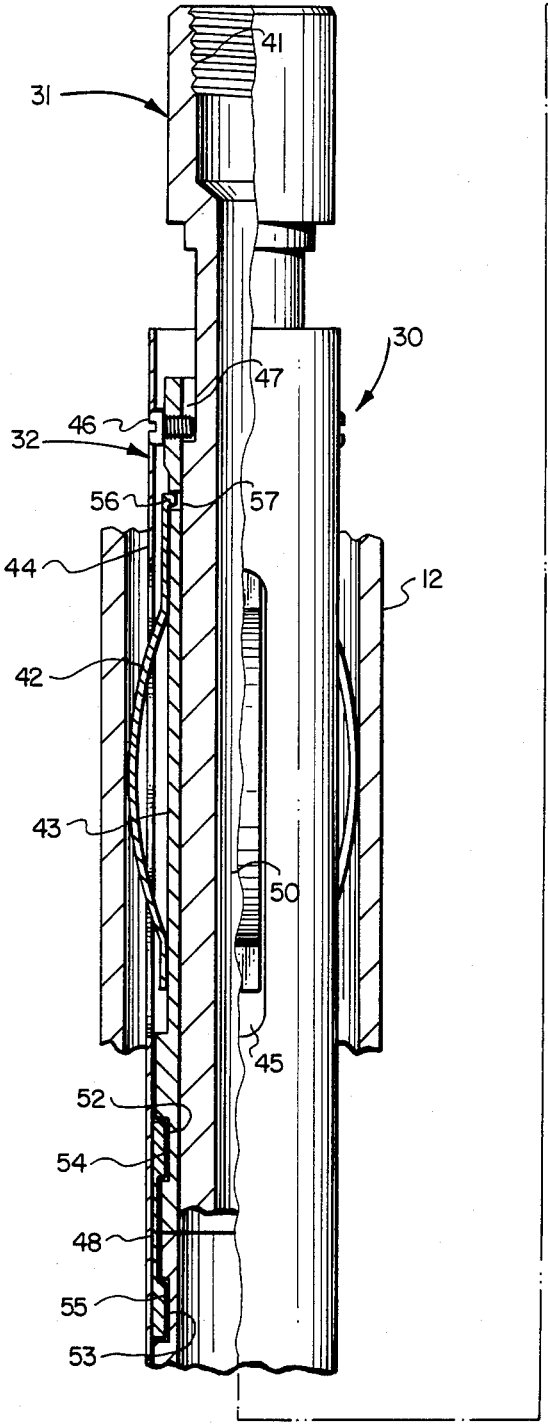
FIGS. 3A and 3B taken together constitute a longitudinal view, partly in section and partly in elevation, showing the tool constructed in accordance with the present invention. The tool is shown extended longitudinally to the uppermost position of the control slot and pin.
Figure 3B:
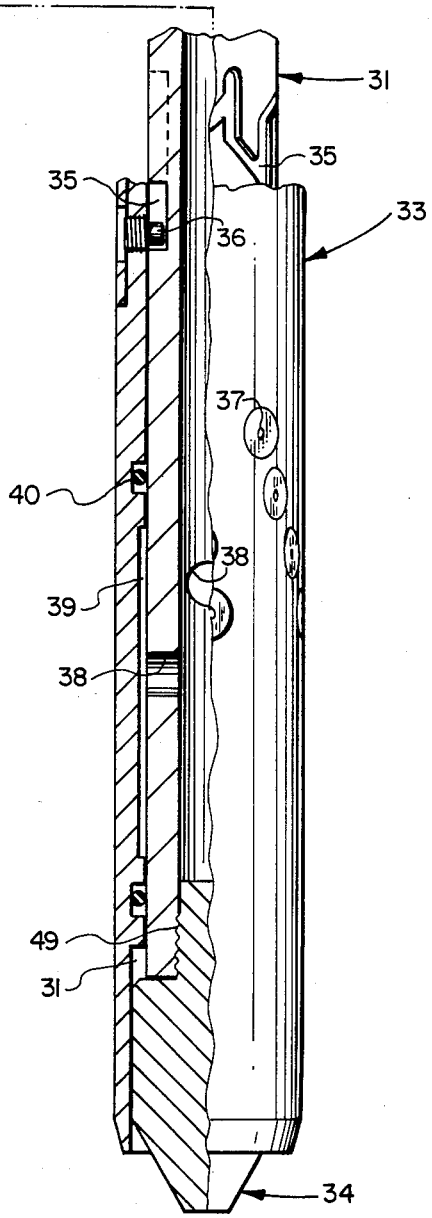
Figure 4:
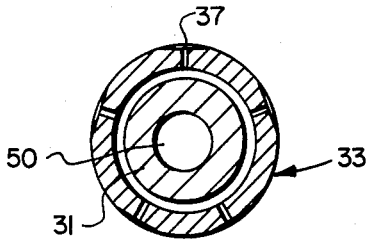
FIG. 4 is a cross-sectional view taken along line 4—4 of FIG. 2B showing the nozzles radiating outwardly through the nozzle body.

As shown in FIGS. 1, 2A, 2B, 3A and 3B, the cleaning fluid is pumped through flexible line 17 from the source of pressurized cleaning fluid 20 into the longitudinal passageway 50. The restriction means 34 causes the cleaning fluid to flow from the longitudinal passageway 50 through the port means 38 which extends laterally through the mandrel means 31 thereby communicating cleaning fluid to the nozzle body means 33. Between the interior of the nozzle body means 33 and the mandrel means 31 is a chamber means 39 formed to receive the cleaning fluid as it arrives from the port means 38. A sealing means 40 is placed at both ends of the chamber means 39 to prevent undesired fluid flow from the chamber means 39. O-rings, among other sealing means, may be used. As shown in FIGS. 2B, 3B and 4, the cleaning fluid is then forced through a nozzle means 37 consisting of a plurality of nozzles extending radially through the nozzle body means 33, and the cleaning fluid is jetted out against the deposits or coatings D on the flow conductor 12.

The nozzle body means 33 is slidably disposed on the exterior of the mandrel means 31. The carrier means 32 is slidably disposed on the mandrel means 31 adjacent to the nozzle body means 33. An example of the means for connecting the carrier means 32 to the nozzle body means 33 is connector means 48. This connector means 48 has two lands, upper land 54 and lower land 55. Upper land 54 fits into carrier circumferential groove 52 in carrier sub 43, part of carrier means 32 and lower land 55 fits into nozzle body circumferential groove 53 in nozzle body means 33. The mating of the upper land 54 and lower land 55 of the connector means 48 in the carrier circumferential groove 52 in carrier sub 43 and nozzle body circumferential groove 53 in nozzle body means 33 provides a means for connecting the carrier means 32 to the nozzle body means 33 and thereby constitutes a portion of the means for translating the longitudinal movement of the carrier means 32 into rotational movement of the nozzle body means 33. An example of the parts that make up the means for selectively rotating the nozzle body means 33 in response to longitudinal movement of the apparatus, herein called cleaning tool 30, are the control slot means 35, the carrier means 32, the pin means 36, the spring means 42 and the connector means 48. The whole process will be readily apparent later in the description.

A further part, spring means 42, of the carrier means 32 is the means for engaging the carrier means 32 with the interior of the flow conductor 12. This spring means 42 allows longitudinal movement of the carrier means 32 relative to the mandrel means 31. Spring means 42 is of such a configuration so as to drag on the interior of flow conductor 12. Spring means 42 is restrained in its movement by the lug 56 which extends into spring circumferential groove 57 in carrier sub 43 and carrier outer sleeve 44, part of carrier means 32, slidably disposed over spring means 42. Spring means 42 is also restrained in its movement by being disposed in spring slot 45 wherein spring means 42 may travel longitudinally to allow for expansion and contraction of spring means 42 as required. As part of carrier means 32, carrier sub 43 is slidably disposed over mandrel means 31 and carrier outer sleeve 44 is slidably disposed over carrier sub 43, connector means 48, pin means 36, and partially over nozzle body means 33. The amount of longitudinal travel of the carrier means 32 relative to the mandrel means 31 is governed by a limiting means shown here as screw 46 and limiting circumferential groove 47.

As shown in FIGS. 2A, 2B, 3A and 3B, the cleaning tool 30 can reciprocate longitudinally a preset distance which is governed by the travel allowed the pin means 36 extended into the control slot means 35 while it travels within the control slot means 35. The control slot means 35 and the pin means 36 provide a portion of the means for translating longitudinal movement of the carrier means 32 into rotation of the nozzle body means 33. The control slot means 35 is formed in the exterior circumference of the mandrel means 31 in a zig-zag pattern. The cleaning tool 30 is reciprocated longitudinally by the longitudinal movement of the flexible line 17 in alternate directions. The downward limit of travel of pin means 36 in control slot 35 is shown in FIGS. 2A and 2B while the upward limit is shown in FIGS. 3A and 3B. As the pin means 36 attached to the nozzle body means 33 travels progressively within the pattern of the control slot means 35 formed in a zig-zag pattern in the exterior circumference of the mandrel means 31, the nozzle body means 33 rotatively and progressively indexes around the mandrel means 31. Both upward and downward longitudinal motion of the cleaning tool 30 will cause the nozzle body means 33 to index and rotate due to the means for selectively rotating the nozzle body means 33 in response to longitudinal movement of cleaning tool 30 termed apparatus in the claims. This rotation of the nozzle body means 33 directs the flow of the cleaning fluid jetting from the nozzle means 37 onto different sections of the flow conductor 12.

The amount of movement by the nozzle body means 33 is predetermined by the configuration of the control slot means 35. The pattern of the control slot means 35 is shown in FIGS. 3B, 5 and 6.

The alternative embodiment 130 of the cleaning tool 30 functions basically in the same manner as cleaning tool 30. The difference between them will now be discussed. In an alternative embodiment 130 of the cleaning tool 30 shown in FIGS. 7A and 7B, the mandrel means 131 has a reduced outside diameter 166. The reduced outside diameter 166 shown is to accommodate a different configuration of the nozzle body means 133 as compared to nozzle body means 33 shown in the preferred embodiment of the cleaning tool 30. The alternative embodiment 130 also contains a restrictive means 134 of changed configuration as compared to restrictive means 34. It will be noticed that restrictive means 134 could be used in the preferred embodiment of the cleaning tool 30 and that restrictive means 34 could be used in the alternative embodiment 130.

Nozzle body means 133, slidably disposed over mandrel means 131, is shown to consist of three parts. Those skilled in the art should be able to see that more or less parts could be used as desired. The three parts are the upper sub **133*a*, the center sub 133*b* and the lower sub 133*c*. Upper sub 133*a* of nozzle body means 133 contains the pin means 136 and has an increased inside diameter 167. Upper sub 133*a* is slidably disposed over mandrel means 131. The exterior of mandrel means 131 and the interior of upper sub 133*a* form part of chamber means 139. Center sub 133*b* is slidably disposed over upper sub 133*a* and abuts at shoulder 168 of upper sub 133*a* and is adjacent to lower sub 133*c*. The exterior of upper sub 133*a* and the interior of center sub 133*b* form another part of chamber means 139. Port means 138 extends laterally through the mandrel means 131 and through the upper sub 133*a* to communicate cleaning fluid from the longitudinal passageway 150 to the center sub 133*b*. Sealing means 140 prevents undesirable fluid flow from the chamber means 139. Sealing means 140 is shown placed in mandrel means 131 and upper sub 133*a*. The sealing means 140** could be placed in other adjacent locations.

Center sub **133*b* has a plurality of first nozzle means 137 extending radially through it to communicate cleaning fluid from the chamber means 139 to the exterior of nozzle body means 133. The first nozzle means 137 direct the pressurized cleaning fluid against the interior diameter of the flow conductor 12 to dislodge the deposits or coatings D shown in FIG. 2B. Center sub 133*b* may be kept from rotating relative to upper sub 133*a* and lower sub 133*c* by an antirotation means 160**.

Lower sub **133*c* of nozzle body means 133 is slidably disposed over mandrel means 131 and threadedly engaged to upper sub 133*a* at lower sub thread 169. As lower sub 133*c* is threaded onto upper sub 133*a*, lower sub 133*c* abuts center sub 133*b* and center sub 133*b* is restricted in its longituidnal movement by lower sub 133*c* and shoulder 168 of upper sub 133*a***.

The center sub **133*b* may be replaced if the first nozzle means 137 wears, a different nozzle size is needed or if a center sub 133*b* without any first nozzle means is desired. A center sub 137 without any first nozzle means used in conjunction with restrictive means 134 would direct all cleaning fluid through restrictive means 134**.

As shown in FIG. 7B, restrictive means 134 consists of two parts: insert sub **134*a* and lower nozzle cap 134*b*. Insert sub 134*a* is threadedly engaged by insert thread 149 to mandrel means 131. The cleaning fluid arriving from first longitudinal passageway 150 of mandrel means 131 enters a second longitudinal passageway 162 of insert sub 134*a*. The second longitudinal passageway 162 flares out to an increased diameter 163. The cleaning fluid then enters restrictive means chamber 165 formed in lower nozzle cap 134*b*. Lower nozzle cap 134*b* contains second nozzle means 164 and is threadedly engaged by lower cap thread 161** to insert sub 134*a*. The pressurized cleaning fluid then is jetted out of second nozzle means 164 against whatever needs to be cleaned below the cleaning tool.

The foregoing descriptions and drawings of the invention are explanatory and illustrative only, and various changes in shapes, sizes and arrangement of parts as well as certain details of the illustrated construction may be made within the scope of the appended claims without departing from the true spirit of the invention.

We claim:

1. An apparatus for cleaning flow conductors comprising:

a. mandrel means having a longitudinal passageway extending therethrough;

b. means for connecting one end of the mandrel means to a source of cleaning fluid;

c. means for restricting fluid flow from the other end of the mandrel means;

d. port means extending laterally through the mandrel means to communicate fluid from the longitudinal passageway to a nozzle body means;

e. said nozzle body means slidably disposed on the exterior of the mandrel means;

f. chamber means formed in the interior of the nozzle body means and the exterior of the mandrel means to receive fluid from the port means;

g. sealing means to prevent undesired fluid flow from the chamber means;

h. a plurality of nozzles extending radially through the nozzle body means to communicate cleaning fluid from the chamber means to the exterior of the nozzle body means; and i. means for selectively rotating the nozzle body means in response to longitudinal movement of the apparatus.

2. An apparatus as defined in claim 1 wherein the selective rotating means further comprises:

a. carrier means slidably disposed on the exterior of the mandrel means adjacent to the nozzle body means;

b. means for engaging the carrier means with the interior of the flow conductor to allow longitudinal movement of the carrier means relative to the mandrel means; and c. means for translating longitudinal movement of the carrier means into rotational movement of the nozzle body means.

3. An apparatus as defined in claim 2 wherein the means for translating longitudinal movement further comprises:

a. control slot means formed in the exterior circumference of the mandrel means;

b. pin means projecting from the interior of the nozzle body means into the control slot means; and c. the control slot means and the pin means providing a portion of the means for translating longitudinal movement of the carrier into rotation of the nozzle body means.

4. An apparatus for cleaning flow conductors comprising:

a. mandrel means having a longitudinal passageway extending therethrough;

b. means for connecting one end of the mandrel means to a source of cleaning fluid;

c. means for restricting fluid flow from the other end of the mandrel means;

d. port means extending laterally through the mandrel means to communicate fluid from the longitudinal passageway to a nozzle body means;

e. said nozzle body means slidably disposed on the exterior of the mandrel means:

f. chamber means formed in the interior of the nozzle body means and the exterior of the mandrel means to receive fluid from the port means;

g. sealing means to prevent undesired fluid flow from the chamber means;

h. plurality of nozzles extending radially through the nozzle body means to communicate cleaning fluid from the chamber means to the exterior of the nozzle body means;

i. carrier means slidably disposed on the exterior of the mandrel means adjacent to the nozzle body means;

j. means for engaging the carrier means with the interior of the flow conductor to allow longitudinal movement of the carrier means relative to the mandrel means;

k. means for selectively rotating the nozzle body means in response to longitudinal movement of the apparatus; and l. means for translating longitudinal movement of the carrier means into rotational movement of the nozzle body means.

5. An apparatus as defined in claim 4 wherein the means for translating longitudinal movement further comprises:

a. control slot means formed in the exterior circumference of the mandrel means;

b. pin means projecting from the interior of the nozzle body means into the control slot means; and c. the control slot means and the pin means providing a portion of the means for translating longitudinal movement of the carrier means into rotation of the nozzle body means.

6. An apparatus as defined in claim 5 wherein the control slot means further comprises a zig-zag pattern formed in the exterior circumference of the mandrel means.

7. An apparatus for cleaning flow conductors comprising:

a. mandrel means having a longitudinal passageway extending therethrough;

b. means for connecting one end of the mandrel means to a source of cleaning fluid;

c. means for restricting fluid flow from the other end of the mandrel means;

d. port means extending laterally through the mandrel means to communicate fluid from the longitudinal passageway to a nozzle body means;

e. said nozzle body means slidably disposed on the exterior of the mandrel means;

f. chamber means formed in the interior of the nozzle body means and the exterior of the mandrel means to receive fluid from the port means;

g. sealing means to prevent undesired fluid flow from the chamber means;

h. plurality of nozzles extending radially through the nozzle body means to communicate cleaning fluid from the chamber means to the exterior of the nozzle body means;

i. carrier means slidably disposed on the exterior of the mandrel means adjacent to the nozzle body means;

j. means for engaging the carrier means with the interior of the flow conductor to allow longitudinal movement of the carrier means relative to the mandrel means;

k. means for selectively rotating the nozzle body means in response to longitudinal movement of the apparatus;

l. means for translating longitudinal movement of the carrier means into rotational movement of the nozzle body means;

m. control slot means formed in the exterior circumference of the mandrel means;

n. pin means projecting from the interior of the nozzle body means into the control slot means; and o. the control slot means and the pin means providing a portion of the means for translating longitudinal movement of the carrier means into rotational movement of the nozzle body means.

8. An apparatus as defined in claim 7 wherein the means for engaging the carrier means with the interior of the flow conductors further comprises:

a. spring means to cause opposite movement of the carrier means relative to the mandrel means; and b. means for securing the spring means to the carrier means.

9. An apparatus as defined in claim 7 wherein a further portion of the means for translating longitudinal movement into rotational movement of the nozzle body means further comprises means for connecting the carrier means to the nozzle body means.

10. An apparatus for cleaning flow conductors comprising:

a. mandrel means having a longitudinal passageway extending therethrough;

b. means for connecting one end of the mandrel means to a source of cleaning fluid;

c. means for restricting fluid flow from the other end of the mandrel means;

d. port means extending laterally through the mandrel means to communicate fluid from the longitudinal passageway to a nozzle body means;

e. said nozzle body means slidably disposed on the exterior of the mandrel means;

f. chamber means formed in the interior of the nozzle body means and the exterior of the mandrel means to receive fluid from the port means;

g. sealing means to prevent undesired fluid flow from the chamber means;

h. plurality of first nozzle means extending radially through the nozzle body means to communicate cleaning fluid from the chamber means to the exterior of the nozzle body means;

i. carrier means slidably disposed on the exterior of the mandrel means adjacent to the nozzle body means;

j. means for engaging the carrier means with the interior of the flow conductor to allow longitudinal movement of the carrier means relative to the mandrel means;

k. spring means to cause opposite movement of the carrier means relative to the mandrel means;

l. means for securing the spring means to the carrier means;

m. means for limiting travel of the carrier means relative to the mandrel means;

n. means for selectively rotating the nozzle body means in response to longitudinal movement of the apparatus;

o. means for translating longitudinal movement of the carrier means into rotational movement of the nozzle body means;

p. control slot means formed in the exterior circumference of the mandrel means;

q. pin means projecting from the interior of the nozzle body means into the control slot means;

r. the control slot means and the pin means providing a portion of the means for translating longitudinal movement of the carrier means into rotational movement of the nozzle body means; and s. means for connecting the carrier means to the nozzle body means providing a further portion of the means for translating longitudinal movement of the carrier means into rotational movement of the nozzle body means.

11. An apparatus as defined in claim 10 wherein the control slot means further comprises a zig-zag pattern.

12. An apparatus as defined in claim 10 wherein the means for restricting fluid flow from the other end of the mandrel means further comprises a second nozzle means spaced along its exterior.

13. An apparatus as defined in claim 10 wherein the nozzle body means further comprises two or more sections that can be replaced separately.

14. An apparatus as defined in claim 10 wherein the nozzle body means further comprises an antirotation means to prevent the sections of the nozzle body means from rotating relative to the other sections of the nozzle body means.

15. An apparatus as defined in claim 10 wherein the nozzle body means has no first nozzle means in order to direct all cleaning fluid to the second nozzle means in the restrictive means.

* * * * *